US005415533A

United States Patent [19]

Egger et al.

[11] Patent Number: 5,415,533

[45] Date of Patent: May 16, 1995

[54] FUEL INJECTION PUMP FOR INTERNAL COMBUSTION ENGINES

[75] Inventors: Klaus Egger, Steyr; Kurt Oberklammer, Neuhofen/Ybbs; Heinz Popp, Raitham; Peter Baumgartner, St. Andrae; Heinz Rathmayr, Hallein, all of Austria

[73] Assignee: Robert Bosch GmbH, Stuttgart, Germany

[21] Appl. No.: 93,823

[22] Filed: Jul. 20, 1993

[30] Foreign Application Priority Data

Aug. 22, 1992 [DE] Germany ..... 42 27 853.8

[51] Int. Cl.[6] ..... F04B 19/00

[52] U.S. Cl. ..... 417/471; 92/129; 123/90.5

[58] Field of Search ..... 417/470, 471; 92/129; 123/90.5

[56] References Cited

U.S. PATENT DOCUMENTS

| | | | |
|---|---|---|---|
| 2,322,356 | 6/1943 | Hahn | 92/129 |
| 2,372,694 | 4/1945 | Tabb | 92/129 |
| 2,984,405 | 5/1961 | Stump | 92/129 |
| 3,139,076 | 6/1964 | Flaherty | 123/90.5 |
| 4,267,977 | 5/1981 | Stockner et al. . | |
| 4,335,685 | 6/1982 | Clouse | 123/90.5 |
| 4,499,873 | 2/1985 | Lehner . | |
| 4,510,796 | 4/1985 | Kampichler . | |
| 4,630,587 | 12/1986 | Hofer et al. . | |

FOREIGN PATENT DOCUMENTS

| | | | |
|---|---|---|---|
| 0173905 | 7/1952 | Germany | 92/129 |
| 1100380 | 2/1961 | Germany . | |
| 3728961 | 3/1989 | Germany . | |
| 3810794 | 10/1990 | Germany . | |
| 1429146 | 3/1976 | United Kingdom . | |
| 8300724 | 3/1983 | WIPO . | |

*Primary Examiner*—Richard A. Bertsch
*Assistant Examiner*—M. Kocharov
*Attorney, Agent, or Firm*—Edwin E. Greigg; Ronald E. Greigg

[57] ABSTRACT

The invention relates to a fuel injection pump for internal combustion engines, having a pump piston guided in a cylinder bore of a pump body, which pump piston defines a pump work chamber in the cylinder bore and which is axially driven by a cam drive counter to the force of a restoring spring. Each individual cylinder of the engine to be fed is assigned a fuel injection pump, which is inserted into a bore in the engine housing; at the same time, the engine housing serves as the pump housing. In order to limit frictional wear, which is caused by the back-and-forth motion of the roller tappet of the cam drive guided in the engine housing and to easily replace pump parts, a thin-walled slide bush is disposed between the roller tappet and the housing bore. The slide bush is fastened with radial play on the pump body and additionally prevents the roller tappet from slipping out and prevents the preassembled fuel injection pump from falling apart when it is not installed in the housing bore.

22 Claims, 4 Drawing Sheets

FUEL INJECTION PUMP FOR INTERNAL COMBUSTION ENGINES

BACKGROUND OF THE INVENTION

The invention is based on a fuel injection pump for internal combustion engines. In a fuel pump of this type known from German Patent DE-OS 39 10 794 Al a separate fuel injection apparatus is associated with each cylinder of the engine to be fed; this apparatus comprises a pump piston guided in a cylinder liner and in it defining a pump work chamber that communicates with the injection point in the combustion chamber of the engine and which is axially driven via a roller tappet of a cam drive counter to the force of a restoring spring. In order to form this single pump element in the simplest manner possible, it does not have its own housing, but rather is so inserted with its pump cylinder into the housing of the engine that the engine housing itself serves as the pump housing, both as a fuel-carrying chamber and as a mechanical guide and support.

Because the roller tappet is guided directly in the engine housing and because of the attendant friction between the parts, the known fuel injection pump experiences increased wear, which can result in the need for replacement of the roller tappet, in addition to cost-intensive remachining of the engine housing.

DE-PS 37 28 961 has already made known a fuel injection pump in the form of a plug-in pump in which the roller tappet of the cam drive slides in a bush slid onto the cylinder liner; however, this particular bush is a self-supporting housing part which has a flange that comes to rest against the bore in the housing of the engine and determines the installed position of the plug-in pump. This pump points into an internal chamber of the engine housing which receives the cam drive for the plug-in pump and has the guide piece for the roller tappet there. Consequently the plug-in pump deviates from the aforementioned fuel injection pump in that it has a housing that is costly to fabricate, that when wear occurs must be replaced or remachined and rebuilt with a matched roller tappet.

OBJECT AND SUMMARY OF THE INVENTION

The fuel injection pump according to the invention has an advantage over the prior art that the mechanical wear as a result of the movement of the roller tappet against the slide bush remains limited by means of disposing the slide bush between the housing bore of the engine and the pump element and more specifically between the housing bore and the roller tappet, and incident variations of the coaxial and parallel position between the roller tappet and the pump body equipped with a cylinder bore can be equalized via the jointlike connection between the pump body and the slide bush.

When long-term wear due to friction necessitates repair, the slide bush, as an expendable part, can now be simply and inexpensively removed and replaced, thus obviating the need for a costly remachining of the engine housing.

The slide bush is simply embodied as a pipe whose walls can be kept very thin since they are not load-bearing and which has very few surfaces to be machined so that this expendable part can be produced at a low production cost. If the slide bush is embodied as a slit pipe, it can furthermore be inserted on installation into the housing bore of the engine without additional securing, due to its initial tension.

Moreover, the slide bush advantageously takes on the task of securing the fuel injection pump during transport, when the pump is not installed in the engine housing, so that a simple preassembly of the pump is possible and the pump can be inserted in the engine housing without additional expenditure.

Embodying of the fit between the slide bush and the pump according to the invention as recited, a further advantage is attained; the coaxial position and tolerance variations, which can be brought into being by tolerances of the housing bore, can be balanced by means of the existing play between the pump body or the roller tappet and the slide bush.

Moreover, during operation of the fuel injection pump, the slide bush advantageously transfers the lateral stress acting on the roller tappet to the engine housing, where it can be absorbed and dissipated.

During operation of the fuel injection pump, the slide bush is held in contact with the pump body by means of the restoring spring axially supported according to claim 11 by a flange ring inside the slide bush, so that axial movements of the slide bush are not possible. The roller tappet has an inserted bolt whose head is guided in a closed longitudinal groove in the slide bush in order to avoid torsion during operation and to prevent the roller tappet connected to the pump piston from slipping out of the slide bush when it is not installed in the engine housing. This connection between the slide bush and the roller tappet can also be effected, via a disk introduced into a bore in the slide bush and protruding into a rectangular, flat recess in the roller tappet. Both versions have the advantage that they make simple removal of the fuel injection pump possible.

In the fuel injection pump according to the invention, rotatability of the pump piston and consequently the space needed for an adjusting device can be dispensed with since control of the injection is handled through the use of a magnet valve, thus making compact construction of the pump possible. The disposition of the magnet valve on and parallel to the axis of the pump body has the advantage with respect to machining that the rotationally symmetrical regions of the pump body and the sealing face of the magnet valve are disposed facing one another, while the rotational and inclined position of the high-pressure connection on the side can be adapted to different installation constraints.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
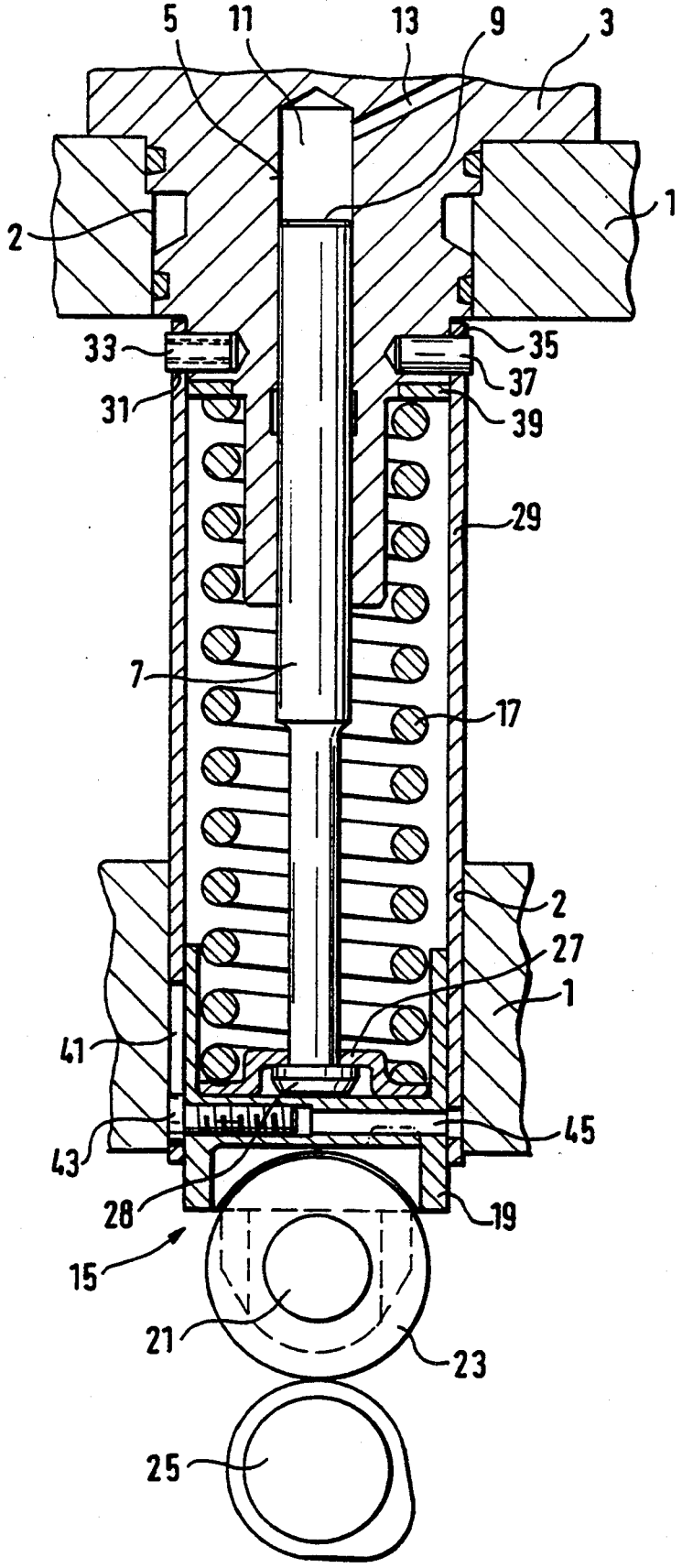
FIG. 1 shows a longitudinal section through a first exemplary embodiment of the fuel injection pump according to the invention and its installed position in the housing of the internal combustion engine to be fed.

FIG. 1 shows a detail of a housing 1 of an internal combustion engine in the region of a fuel injection pump inserted into a housing bore 2. This fuel injection pump comprises a pump body 3 having a blind bore-shaped cylinder bore 5, in which a pump piston 7 is sealingly guided, which piston, with its face end 9, defines a pump work chamber 11 in the cylinder bore 5. Via a fuel line 13 including a reversing valve, not shown in the drawing, the pump work chamber 11 communicates with a fuel-carrying low-pressure chamber and with an injection point, likewise not shown, in the combustion chamber of the engine to be fed; a separate pump element embodied as the pump body 3 and the pump piston 7 is associated with each cylinder of the engine.

The pump piston 7 is driven by a cam drive 15 belonging to the engine counter to the force of a restoring spring 17. To that end, the pump piston 7 is connected on its end remote from the pump work chamber to a cylindrical roller tappet 19, which with its roller 23, disposed on the roller bolt 21 via a slide apron, runs off a secondary cam shaft driven by the engine. By the restoring spring 17, which is disposed between the pump body 3 and the roller tappet 19, the pump piston 7 is held in contact during its downward motion, which corresponds to the intake stroke, with the roller tappet 19, which in turn is held in contact with the cam shaft 25 via a spring plate 27, which is guided on the circumference of the slide apron and fits over a plunger 28 of the pump piston 7.

In order to avoid wear on the wall of the housing bore as a result of the sliding abrasion with the roller tappet 19, a thin-walled slide bush 29, is slipped in between the roller tappet 19 and the part of the housing bore 2 into which it is guided, having tight sliding fit. In the first exemplary embodiment shown in FIG. 1, this slide bush 29 has a bore 31 in its upper end, which is slid onto the pump body 3. A bolt 33, screwed or pressed into the pump body 3 after the slide bush 29 is mounted, protrudes with adequate play into the bore 31. This bolt 33 consequently keeps the slide bush 29 from detaching from the pump body 3 during transport of the preassembled fuel injection pump before it is installed. The bolt 33 has an internal thread via which it can easily be removed in case the slide bush 29 needs to be disassembled. The play both at the bolt and between the slide bush 29 and the pump body 3 enables a slight pivotal action, which is necessary in order to compensate for production-dictated angle and position tolerances of the housing bore 2 and of the parts of the fuel injection pump.

In order to guarantee centering and fixation of the rotational position of the slide bush 29 relative to the pump body 3, a fitting slit is incorporated into the slide bush 29, which is engaged by a further fitting bolt 37 disposed radially in the pump body.

In the interior of the slide bush 29, a flange ring 39 is welded on, via which the slide bush 29 is axially supported on the pump body 3 and whose side remote from the pump body 3 is engaged by the restoring spring 17, so that an axial movement of the slide bush 29 is avoided despite the possible introduction of force upon it and so that the slide bush 29 is held in contact with the pump body 3.

On its end that guides the roller tappet 19, the slide bush 29 has a closed longitudinal slit 41, protruding into which is the head of a bolt 43, which is radially screwed or pressed into the roller tappet 19 as a guide piece, so that here also, a fixation of the rotational position of the roller tappet 19, and moreover protection against slippage of the roller tappet 19 out of the slide bush 29 when the fuel injection pump is pulled out of the housing bore 2, are guaranteed. In order to be able to loosen this bolt 43 once again, in the case where it has been pressed into the roller tappet 19 and if removal of the fuel injection pump becomes necessary, for example in order to replace the slide bush 29, the bore that receives the bolt 43 is embodied as a through bore 45.

If the bolt 43 is received in the roller tappet 19 via a sliding seat, the initial tension of the restoring spring 17 guarantees the secure position of the bolt during transport.

Figure 2:
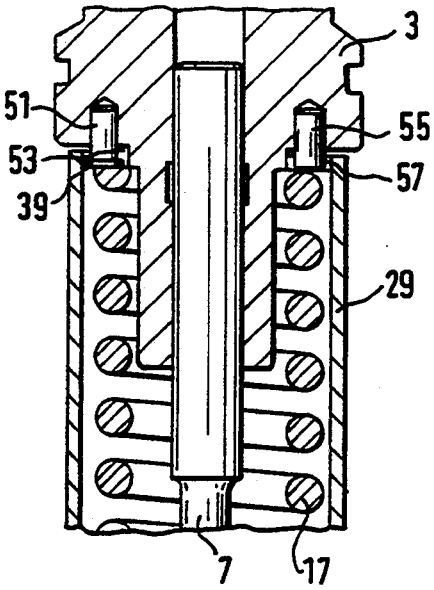
FIG. 2 shows a second exemplary embodiment in a detail from FIG. 1 in which the slide bush according to the invention is fastened to the pump housing via axial bolts.

FIG. 2 shows a second exemplary embodiment that differs from the first merely in the manner of the attachment of the slide bush 29 to the pump body 3, so FIG. 2 merely shows this connection. The connection is achieved here via a collared bolt 51, which is screwed or pressed into the pump body 3 in an axial direction of the pump piston 7. Sufficient radial and axial play is provided in the receiving slit 53 of this collared bolt 51 in the flange ring 39 of the slide bush 29, in order to compensate for production-dictated position and angle tolerances. When required, as in the first exemplary embodiment, the number of collared bolts 51 can be increased. The bolt 55, guided through a fitting slit 57 in the flange ring 39 and likewise pressed in an axial direction into the pump body 3, takes on the task of fixing the rotational position of the slide bush 29 relative to the pump body 3, with the aid of the close sliding seat of the slide bush 29 in the housing bore 2.

Figure 3:
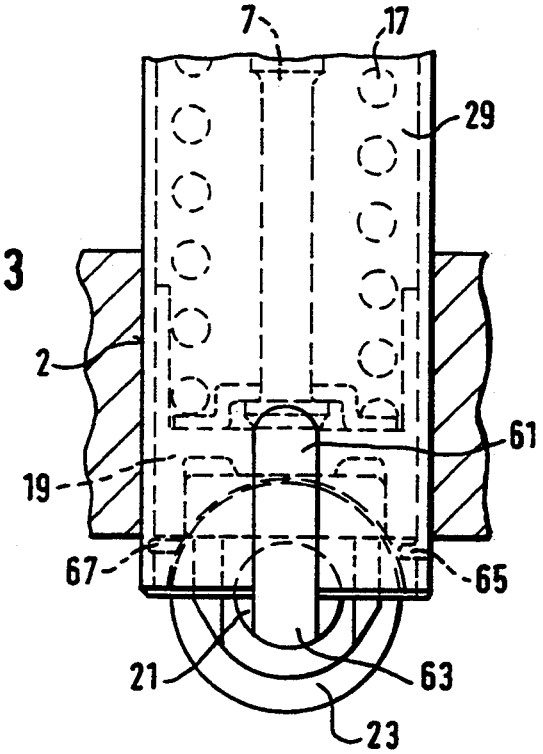
FIG. 3 shows a third exemplary embodiment in which the roller tappet is axially secured via a stop disposed in the slide bush.

The third exemplary embodiment shown in FIG. 3 is limited to showing the connection of the slide bush 29 to the roller tappet 19. The slide bush 29 is extended as far as the middle of the roller bolt 21, which is in its position in which it is displaced the farthest downward by the restoring spring 17, which reduces the torque load acting on the roller tappet 19. Fixation of the rotational position of the roller tappet 19 is achieved here via a longitudinal slit 61 in the slide bush 29, which is engaged by the ends 63 of the roller bolt 21, that serve as a guide piece. The task of securing during transport is performed by tabs 65 bent inward or by a wire ring 67 inserted into the interior of the slide bush 29, with which the roller tappet 19 is put into contact by the restoring spring 17.

Figure 4:
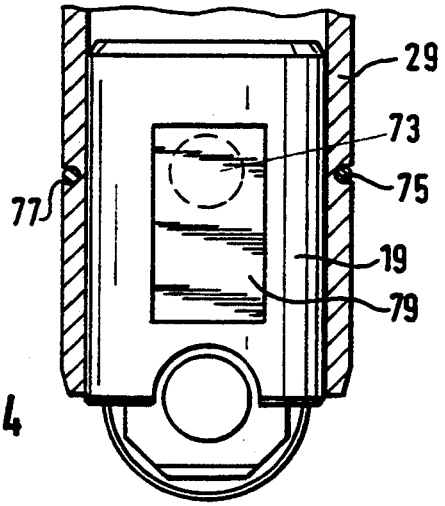
FIGS. 4 and 5 show a fourth exemplary embodiment in two views analogous to FIG. 3 in which the roller tappet is axially secured via a disk that is inserted through the slide bush.
Figure 5:
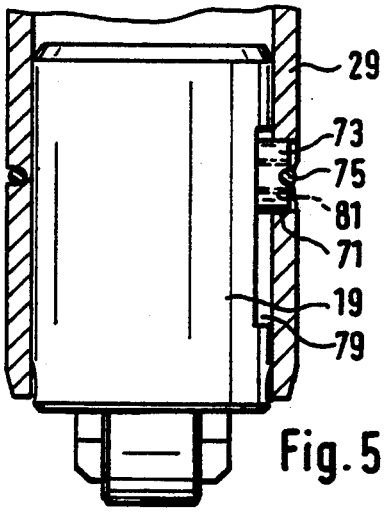

FIGS. 4 and 5 show a fourth variant embodiment analogous to that shown in FIG. 3, in which a cylindrical disk 73 is situated as a guide piece in a radial bore 71 in the slide bush 29; by means of a wire ring 75, which is guided in an external annular groove in the slide bush 29, the disk 73 is pressed against a flattened, rectangular, planar recess 79, which runs perpendicular to the axis of the pump piston and does not go all the way through. The horizontal edges of the recess 79 define the axial movement of the roller tappet 19 in the slide bush 29, which is tightly connected to the pump body 3, while the vertical edges of the recess 79 serve to fix the rotational position. To make for an easier removal, an internal thread can be made in the disk 73 and can be engaged with a tool.

Figure 6:
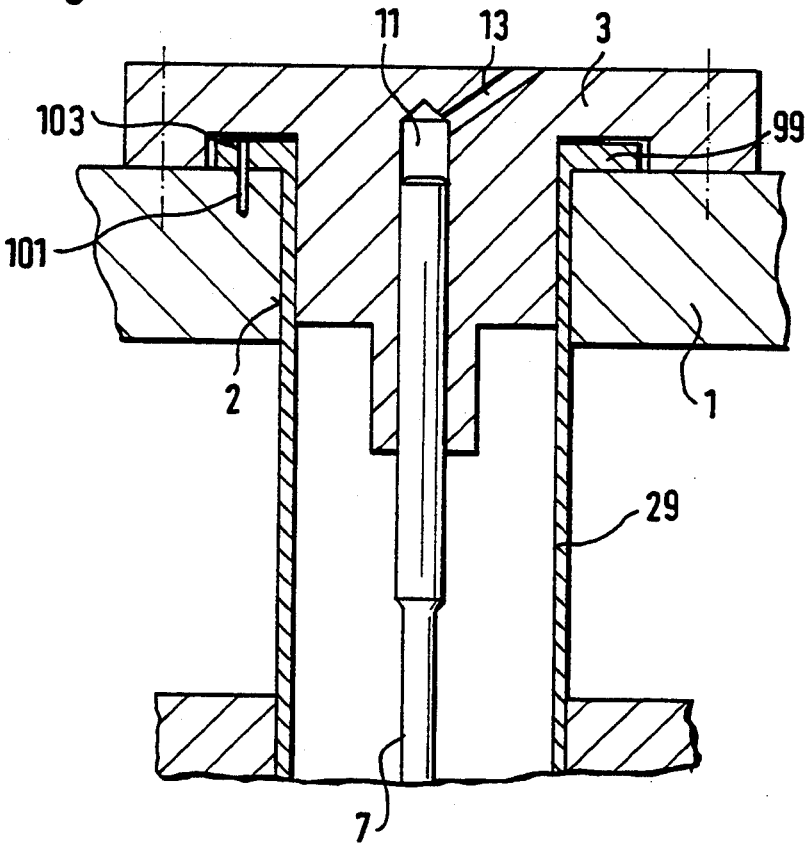
FIG. 6 shows a further exemplary embodiment of the slide bush in the form of a slit pipe.

FIG. 6 shows a fifth exemplary embodiment in which the slide bush 29 is embodied as a slit pipe, both of whose ends are slipped into the housing bores 2; a slippage of the slide bush 29 into the housing bore 2 is avoided via a flanged portion 99 disposed on the upper end of the slide bush 29, via which the slide bush 29 can be axially braced by the pump body 3 against the housing 1. In addition, the flanged portion 99 serves to aid in the removal of the slit slide bush 29, which is inserted in the housing bore 2 with initial tension.

Figure 7:
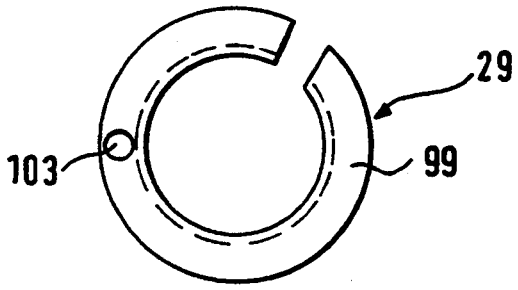
FIG. 7 shows a top view of the slide bush by itself.

To secure against torsion, the slit slide bush 29, shown by itself in a top view in FIG. 7, has an axially directed bore 103 in its flanged portion 99, by means of which a drift pin 101 is inserted in a snug-fit bore in the motor housing.

Figure 8:
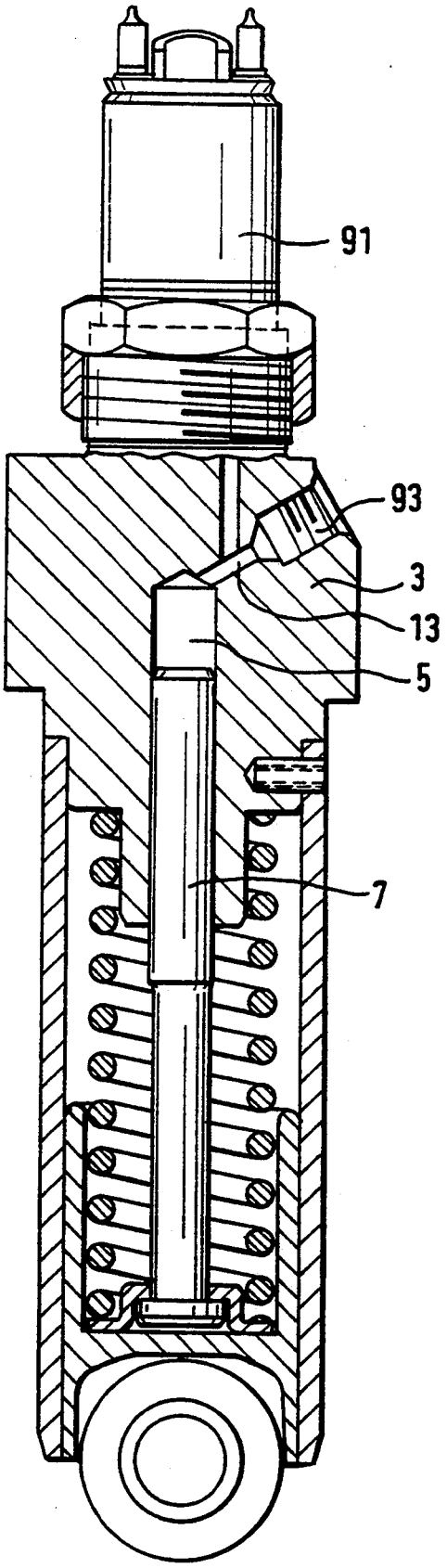
FIG. 8 shows a sixth exemplary embodiment of the subject of the invention in which a magnet valve, which controls the injection event, is disposed on and parallel to the axis of the pump body of the fuel injection pump.

FIG. 8 shows a sixth exemplary embodiment analogous to that shown in FIG. 1, in which a magnet valve 91, which controls the injection event, is disposed coaxially in line with and directly on the pump body 3 and in which a high-pressure connection is embodied on the side of the pump body 3, so that the rotationally symmetrical machining surfaces of the pump body 3 and magnet valve 91 face one another, while the rotational and inclined position of the high-pressure connection can be adapted to different installation constraints. This is achieved by means of the blind bore-shaped cylinder bore 5, which makes possible a free choice of the position of the fuel line 13 and of the high-pressure connection 93.

With the fuel injection pump according to the invention, it is consequently possible, despite a compact construction, to reduce the wear on an easily-replaceable, inexpensive-to-produce pump part; this slide bush 29 additionally takes on the task of securing the whole fuel injection pump when it is not installed in the motor housing.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines that supplies fuel to an individual injection valve associated with a cylinder of the internal combustion engine, having a pump body (3) which is inserted into a bore (2) in a housing (1) of the engine, said pump body includes a cylinder bore (5), a pump piston (7), guided in the cylinder bore of the pump body, said pump piston encloses a pump work chamber (11) in said cylinder bore, said pump piston (7) is axially set in motion by a cam drive (15) provided in the engine housing (1) via a roller tappet (19), which is guided in the engine housing (1) and secured against torsion, counter to a force of a restoring spring (17) which is supported on the pump body (3) and the roller tappet (19), the roller tappet (19) is guided in a slide bush (29), which is introduced between said roller tappet and the engine housing (1), said slide bush is inserted into the housing bore (2) and is fastened so that the slide bush does not rotate, said slide bush also encompasses the restoring spring (17) and a part of the pump body (3), and a bolt (43) extending into said tappet includes a head which slides in a longitudinal slit (41) in said slide bush (29), said bolt (43) and longitudinal slit connection connects the roller tappet (19) in the slide bush (29), to fix the rotational position of the roller tappet (19) relative to the cam drive (15).

2. A fuel injection pump according to claim 1, in which the slide bush (29) has an axially oriented stop, by means of which the displaceability of the roller tappet (19) is defined and influenced by the force of the restoring spring (17), wherein the restoring spring (17) is inserted, with initial tension, between the pump body (3) and the roller tappet (19).

3. A fuel injection pump according to claim 2, in which the bolt (43) is inserted into said roller tappet perpendicular to an axis of the pump piston, said bolt prevents torsion, by engaging said longitudinal slit (41), which is closed on opposite ends, in the slide bush (29), wherein one end of the longitudinal slit (41) serves as an axial stop for the bolt (43) and the roller tappet (19).

4. A fuel injection pump according to claim 3, in which the slide bush (29) is embodied as a tube and is fastened on the pump body (3) with radial play, wherein the restoring spring (17) is supported on the pump body (3).

5. A fuel injection pump according to claim 2, in which the slide bush (29) has an axial stop supported by a wire ring (67) guided in an annular groove, and the slide bush (29) extends axially to a height of a roller bolt (21), which carries the roller (23) in the roller tappet (19) and penetrates the roller tappet (19) transversely to its longitudinal axis.

6. A fuel injection pump according to claim 5, in which the roller bolt (21) has ends (63), with which it is guided in longitudinal slits (61) in the slide bush (29) that form a guide.

7. A fuel injection pump according to claim 2, in which the slide bush (29) has a tab (65) angled inward on an interior of an end remote from the pump body (3) which functions as an axial stop, and the slide bush (29) extends axially to a height of a roller bolt (21), which carries the roller (23) in the roller tappet (19) and penetrates the roller tappet (19) transversely to its longitudinal axis.

8. A fuel injection pump according to claim 7, in which the slide bush (29) is embodied as a tube and is fastened on the pump body (3) with radial play, wherein the restoring spring (17) is supported on the pump body (3).

9. A fuel injection pump according to claim 7, in which the roller bolt (21) has ends (63), with which it is guided in longitudinal slits (61) in the slide bush (29) that form a guide.

10. A fuel injection pump according to claim 9, in which the slide bush (29) is embodied as a tube and is fastened on the pump body (3) with radial play, wherein the restoring spring (17) is supported on the pump body (3).

11. A fuel injection pump according to claim 2, in which in the region of the roller tappet (19), the slide bush (29) has a radial bore (71) into which a cylindrical disk (73) is inserted as a guide piece, said cylindrical disk (73) is pressed inwardly by means of a wire ring (75) guided in an external annular groove (77) on the slide bush (29) against a flattened, rectangular, planar recess (79) on the roller tappet (19) that the cylindrical disk extends in the direction of the axis of the pump piston, wherein the horizontal edges of said recess (79) function as a stop which defines an axial travel of the roller tappet (19) in the slide bush (29) and the vertical edges serve to fix the rotational position of the roller tappet (19).

12. A fuel injection pump according to claim 11, in which the slide bush (29) is embodied as a tube and is fastened on the pump body (3) with radial play, wherein the restoring spring (17) is supported on the pump body (3).

13. A fuel injection pump according to claim 11, in which the cylindrical disk (73) has an internal thread and means by which a tool can engage said cylindrical disk to remove it from the bore (71).

14. A fuel injection pump according to claim 13, in which the restoring spring (17) is supported at one end on the roller tappet (19) and is axially supported on another end on a flange ring (39), which contacts the pump body (3) and is disposed in the slide bush (29).

15. A fuel injection pump according to claim 1, in which the slide bush (29) is embodied as a pipe having thin walls, which is inherently stable with reference to forces exerted during installation and which is secured against tensile strain by means of the restoring spring (17) with initial tension, and which is inserted, with tight sliding play, between a region that receives the roller tapper (19) and the wall of the housing bore (2).

16. A fuel injection pump according to claim 15, in which the slide bush (29) is embodied as a tube and is fastened on the pump body (3) with radial play, wherein the restoring spring (17) is supported on the pump body (3).

17. A fuel injection pump according to claim 12, in which the connection between the slide bush (29) and the pump body (3) is effected via a collared bolt (51) inserted into the pump body (3) along the axis of the pump piston and guided in a flange ring (39) by means of a bore (53), and the rotational position of the slide bush (29) relative to the pump body (3) is fixed by means of a drift pin (55).

18. A fuel injection pump according to claim 1, in which the slide bush (29) is embodied as a thin-walled pipe that is slit axially along its entire length, which is inserted in the housing bore (2) of the fuel injection pump and is braced axially against the pump body (3) via a flanged portion (99), which protrudes from the housing bore (2).

19. A fuel injection pump according to claim 18, in which the slide bush (29) is embodied as a tube and is fastened on the pump body (3) with radial play, wherein the restoring spring (17) is supported on the pump body (3).

20. A fuel injection pump according to claim 1, in which the slide bush (29) is connected to the pump body (3) by means of a bolt (33) inserted radially in the pump body (3) and which protrudes into a bore (31) in the slide bush (29), and in a predetermined rotational position is affixed to the pump body (3) by means of a drift pin (37).

21. A fuel injection pump according to claim 1, in which the injection control is effected via a magnet valve (91) that communicates with the pump work chamber (11) by means of a fuel line (13).

22. A fuel injection pump according to claim 21, in which the magnet valve (91) is disposed in line with, parallel to the axis of, and directly on the pump body (3), and the cylinder bore (5), which defines the pump work chamber (11), is embodied as a blind bore from which a high-pressure connection (93), which is embodied on a side of the pump body (3), extends laterally.

* * * * *